US010429121B2

(12) United States Patent
Yoon et al.

(10) Patent No.: US 10,429,121 B2
(45) Date of Patent: Oct. 1, 2019

(54) REFRIGERATOR

(71) Applicant: SAMSUNG ELECTRONICS CO., LTD., Suwon-si, Gyeonggi-do (KR)

(72) Inventors: Seok Jun Yoon, Suwon-si (KR); Seung Yong Yang, Hwaseong-si (KR); Su Cheol Yoo, Hwaseong-si (KR); Ha-Jin Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 297 days.

(21) Appl. No.: 14/943,336

(22) Filed: Nov. 17, 2015

(65) Prior Publication Data

US 2016/0146528 A1 May 26, 2016

(30) Foreign Application Priority Data

Nov. 26, 2014 (KR) ..... 10-2014-0166026

(51) Int. Cl.
*F25D 21/04* (2006.01)
*F25D 23/02* (2006.01)

(52) U.S. Cl.
CPC ..... *F25D 21/04* (2013.01); *F25D 23/028* (2013.01); *F25D 2323/021* (2013.01)

(58) Field of Classification Search
CPC ... F25D 23/028; F25D 21/04; F25D 2323/021
(Continued)

(56) References Cited

U.S. PATENT DOCUMENTS 2,135,091 A * 11/1938 Newill ..... F25D 21/04 62/165
2,401,613 A * 6/1946 Charland ..... F25D 11/025 312/328

(Continued)

FOREIGN PATENT DOCUMENTS

CN 201569237 U 9/2010
CN 102927740 A 2/2013

(Continued)

OTHER PUBLICATIONS

Chinese Office Action dated Sep. 4, 2017 in corresponding Chinese Patent Application No. 201510844680.X.

(Continued)

*Primary Examiner* — Ana M Vasquez
(74) *Attorney, Agent, or Firm* — Staas & Halsey LLP

(57) ABSTRACT

A refrigerator including a body having an inner casing and an outer casing, a storage compartment provided in the body to allow a front surface thereof to be open, a door including a first door and a second door pivotably coupled with both sides of the body and configured to open and close the open front surface of the storage compartment, a pivoting bar pivotably coupled with the first door, a guide device coupled with the body to induce the pivoting bar to pivot, a heat transfer pipe installed between the inner casing and the outer casing and configured to extend along a front edge of the storage compartment to allow a refrigerant to be movable therein, and a heat transfer member in contact with the heat transfer pipe and the guide device, and which is formed of a material having a higher thermal conductivity than the inner casing.

10 Claims, 16 Drawing Sheets

(58) Field of Classification Search
USPC ..... 62/277; 312/405, 406.1
See application file for complete search history.

(56) References Cited

U.S. PATENT DOCUMENTS

| | | | | | |
|---|---|---|---|---|---|
| 2,537,314 | A * | 1/1951 | Mortensen | F25D 11/025 | 220/592.02 |
| 2,613,509 | A * | 10/1952 | Philipp | F25D 11/025 | 220/592.06 |
| 2,639,592 | A * | 5/1953 | Philipp | F25D 11/025 | 312/406 |
| 3,984,223 | A * | 10/1976 | Whistler, Jr. | F25D 21/04 | 62/277 |
| 4,192,149 | A * | 3/1980 | Webb | F25D 21/04 | 62/151 |
| 4,711,098 | A * | 12/1987 | Kuwabara | F25D 11/022 | 312/321.5 |
| 4,884,415 | A * | 12/1989 | Mandel | F25D 21/04 | 62/277 |
| 5,411,328 | A * | 5/1995 | You | F25D 23/028 | 312/296 |
| 6,393,855 | B1 * | 5/2002 | Schuchert | F25D 21/04 | 62/275 |
| 6,428,130 | B1 * | 8/2002 | Banicevic | F25D 21/04 | 312/296 |
| 2005/0046319 | A1 * | 3/2005 | Chekal | F25D 11/02 | 312/401 |
| 2008/0209812 | A1 * | 9/2008 | Lancry | F25D 21/04 | 49/316 |
| 2012/0102985 | A1 * | 5/2012 | Tafoya | F25D 21/04 | 62/81 |

FOREIGN PATENT DOCUMENTS

| | | | |
|---|---|---|---|
| CN | 103471325 | A | 12/2013 |
| CN | 103575028 | A | 2/2014 |
| JP | 2009-156478 | | 7/2009 |
| KR | 20-1999-0007713 | | 2/1999 |
| KR | 10-2013-0105543 | | 9/2013 |
| KR | 10-2015-0082065 | | 7/2015 |

OTHER PUBLICATIONS

Decision on Grant dated Jan. 3, 2018, in corresponding Chinese Patent Application No. 201510844680.X.

Korean Office Action dated Oct. 26, 2018 in corresponding Korea Patent Application No. 10-2014-0166026.

Korean Patent Office Action issued in Korean Patent Application No. 10-2014-0166026 dated Apr. 19, 2019.

* cited by examiner

REFRIGERATOR

CROSS-REFERENCE TO RELATED APPLICATION

This application claims the benefit of Korean Patent Application No. 10-2014-0166026, filed on Nov. 26, 2014 in the Korean Intellectual Property Office, the disclosure of which is incorporated herein by reference.

BACKGROUND

1. Field

Embodiments of the present disclosure relate to a refrigerator having an improved structure capable of preventing a dew formation phenomenon in a refrigerator having a pivoting bar.

2. Description of the Related Art

Generally, refrigerators supply a cool air generated by an evaporator to a storage compartment to maintain the freshness of various types of food stored therein for a long time. Refrigerators, depending on a type thereof, may include a plurality of storage compartments. Storage compartments of a refrigerator are divided into a refrigerating compartment which is maintained at about 3° C. and keeps food refrigerated and a freezing compartment which is maintained at about −20° C. and keeps food frozen.

Types of refrigerators may be divided according to shapes of storage compartments and a door thereof. Top mounted freezer (TMF) type refrigerators include storage compartments partitioned by a horizontal partition into top and bottom compartments, in which the freezing compartment is formed above the refrigerating compartment and the refrigerating compartment is formed below the freezing compartment. Bottom mounted freezer (BMF) type refrigerators include the refrigerating compartment formed above the freezing compartment and the freezing compartment formed below the refrigerating compartment. Side by side (SBS) type refrigerators include storage compartments partitioned by a vertical partition into left and right compartments, in which a freezing compartment is formed on one side of the partition and a refrigerating compartment is formed on the other side of the partition. French door refrigerator (FDR) type refrigerators include storage compartments partitioned by a horizontal partition, in which a refrigerating compartment is formed above the freezing compartment and a freezing compartment is formed below the refrigerator compartment while the refrigerating compartment on top of the freezing compartment is opened and closed by a pair of doors.

A gasket is provided on a door of a refrigerator. When the door is closed, the gasket seals a gap between the door and a body. However, in the case of FDR type refrigerators, since a refrigerating compartment is opened and closed by a pair of doors without the inclusion of a vertical partition in the refrigerator compartment, it is impossible to seal a gap between the pair of doors. Accordingly, a pivoting bar pivotably installed on one of the pair of doors to seal the gap between the pair of doors has been proposed.

A guide device which guides the pivoting bar to pivot during a door opening and closing process is installed on one side of the body. The guide device is generally installed on an outer surface of an inner casing to face the doors. The guide device may be located inside the storage compartment together with the pivoting bar when the doors are closed. The pivoting bar includes an insulator and a heating wire therein to reduce a difference in temperature between the pivoting bar and the outside when the doors are opened. However, since the guide device does not include an insulator and a heating wire therein, when the doors are opened, a dew formation phenomenon may occur on the guide device due to a difference in temperature between the guide device and the outside.

SUMMARY

Therefore, it is an aspect of one or more embodiments of the present disclosure to provide a refrigerator having an improved structure capable of increasing quality and preventing the corrosion of metal by preventing a dew formation phenomenon which occurs in the refrigerator.

It is an aspect of one or more embodiments of the present disclosure to also provide a refrigerator having an improved structure capable of preventing the dew formation phenomenon in a guide device which guides a pivoting bar.

Additional aspects of embodiments of the present disclosure will be set forth in part in the description which follows and, in part, will be obvious from the description, or may be learned by practice of embodiments.

In accordance with one aspect of one or more embodiments of the present disclosure, a refrigerator includes a body including an inner casing and an outer casing, a storage compartment provided in the body to allow a front surface thereof to be open, a door including a first door and a second door pivotably coupled with both sides of the body and configured to open and close the open front surface of the storage compartment, a pivoting bar pivotably coupled with the first door, a guide device coupled with the body to induce the pivoting bar to pivot, a heat transfer pipe installed between the inner casing and the outer casing and configured to extend along a front edge of the storage compartment to allow a refrigerant to be movable therein, and a heat transfer member whose one side is in contact with the heat transfer pipe and whose other side is in contact with the guide device, wherein the heat transfer member is formed of a material having a higher thermal conductivity than the inner casing.

The heat transfer member may include a first connection portion having a shape which surrounds a part of the heat transfer pipe.

The first connection portion may be disposed between the inner casing and the outer casing.

The heat transfer member may further include a second connection portion which is bent from the first connection portion and in contact with the guide device.

The second connection portion may be disposed between the inner casing and the guide device coupled with the inner casing.

The heat transfer member may include aluminum.

In accordance with another aspect of one or more embodiments of the present disclosure, a refrigerator includes a body including an inner casing and an outer casing, a storage compartment provided in the body to allow a front surface thereof to be open, a door including a first door and a second door pivotably coupled with both sides of the body and configured to open and close the open front surface of the storage compartment, a pivoting bar pivotably coupled with the first door, a guide device coupled with the body to induce the pivoting bar to pivot, a heat transfer pipe installed between the inner casing and the outer casing and disposed at a front edge of the storage compartment to allow a refrigerant to be movable therein, and a heat transfer member installed to transfer heat from the heat transfer pipe to the guide device to increase a temperature of the guide device.

The heat transfer member may be formed of a material having a higher thermal conductivity than the inner casing.

The heat transfer member may include aluminum.

The heat transfer member may include a first connection portion having a shape which surrounds a part of the heat transfer pipe.

The first connection portion may be disposed between the inner casing and the outer casing.

The heat transfer member may further include a second connection portion which is bent from the first connection portion and in contact with the guide device.

The second connection portion may be disposed between the inner casing and the guide device coupled with the inner casing.

BRIEF DESCRIPTION OF THE DRAWINGS

These and/or other aspects of embodiments of the present disclosure will become apparent and more readily appreciated from the following description of embodiments, taken in conjunction with the accompanying drawings of which.

DETAILED DESCRIPTION

Figure 1:
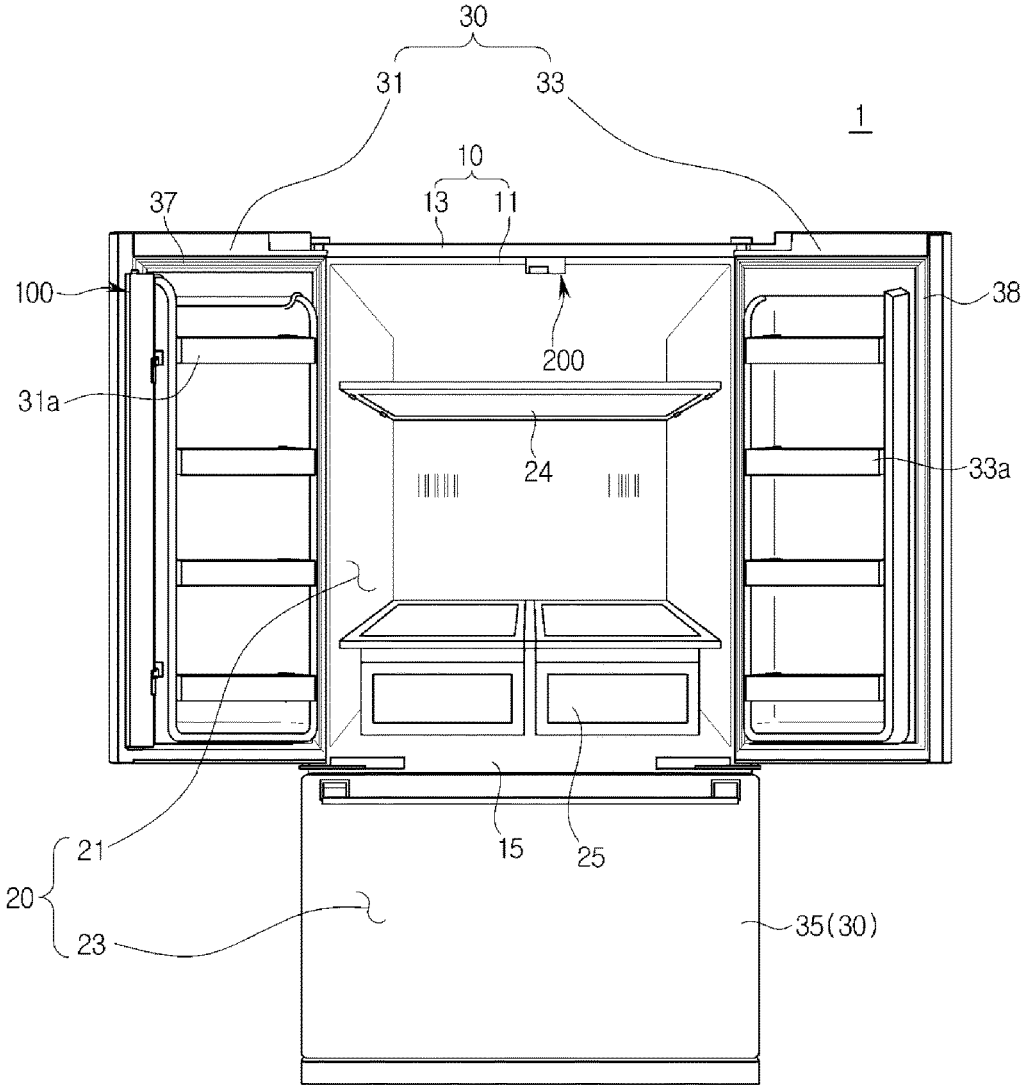
FIG. 1 is a front view of a refrigerator in accordance with one embodiment of the present disclosure.

Reference will now be made in detail to the embodiments of the present disclosure, examples of which are illustrated in the accompanying drawings, wherein like reference numerals refer to like elements throughout.

Hereinafter, embodiments of the present disclosure will be described in detail with reference to the attached drawings.

As shown in FIG. 1, a refrigerator 1 includes a body 10 which forms an exterior, a storage compartment 20 formed in the body 10 while being partitioned into top and bottom compartments, and a door 30 which opens and closes the storage compartment 20.

The body 10 may include an inner casing 11 which forms the storage compartment 20 and an outer casing 13 which is coupled with an outside of the inner casing 11 and forms the exterior. Although not shown in the drawings, an insulator may be injected between the inner casing 11 and the outer casing 13 to prevent a cool air inside the storage compartment 20 from being discharged.

The storage compartment 20 is configured to have an open front. The storage compartment 20 may be provided in plural number. The storage compartment 20 may include a first storage compartment 21 provided above a second storage compartment 23 and the second storage compartment 23 provided below the first storage compartment 21. The body 10 may include a partition 15 which partitions the storage compartments 20 into the first storage compartment 21 on top and the second storage compartment 23 on bottom. The first storage compartment 21 may be provided as a refrigerating compartment, and the second storage compartment 23 may be provided as a freezing compartment.

The storage compartment 20 may include a shelf 24 which supports food. A plurality of such shelves 24 may be provided depending on a size of the storage compartment 20. Also, the storage compartment 20 may include a storage container 25. The storage container 25 may have a space for containing food therein.

The storage compartment 20 is opened and closed by the door 30. The door 30 may include a pair of doors 31 and 33 pivotably coupled with the body 10 to open and close the first storage compartment 21.

The pair of doors 31 and 33 may be installed on the left and right of the first storage compartment 21 to open and close the first storage compartment 21. In a front view, the pair of doors 31 and 33 may include a first door 31 disposed in the left of the body 10 and a second door 33 disposed in the right of the body 10.

The first door 31 may open and close a left part of an open front of the first storage compartment 21, and the second door 33 may open and close a right part of the open front of the first storage compartment 21.

A plurality of door guards 31*a* and 33*a* able to store food and the like may be provided in rear surfaces of the first door 31 and the second door 33, respectively. A first gasket 37 and a second gasket 38 which seal gaps between the first door 31 and the second door 33 and the body 10 while the first door 31 and the second door 33 are closed may be provided on edges of the rear surfaces of the first door 31 and the second door 33.

The door 30 may further include a drawable door 35. The drawable door 35 may be drawably mounted on the body 10 and may open and close the second storage compartment 23, respectively.

The refrigerator 1 further includes a cool air supplying device (not shown) which supplies the cool air to the storage compartment 20.

The cool air supplying device may include a compressor (not shown) which compresses a refrigerant, a condenser (not shown) which condenses the refrigerant, an expansion valve (not shown) which expands the refrigerant, and an evaporator (not shown) which evaporates the refrigerant. The cool air supplying device may drive a freezing cycle including compression, condensation, expansion, and evaporation processes while the refrigerant circulates through the compressor, the condenser, the expansion valve, and the evaporator. The cool air supplying device may generate the cool air in the storage compartment 20 through heat exchange generated while the refrigerant circulates in the freezing cycle.

Figure 2:
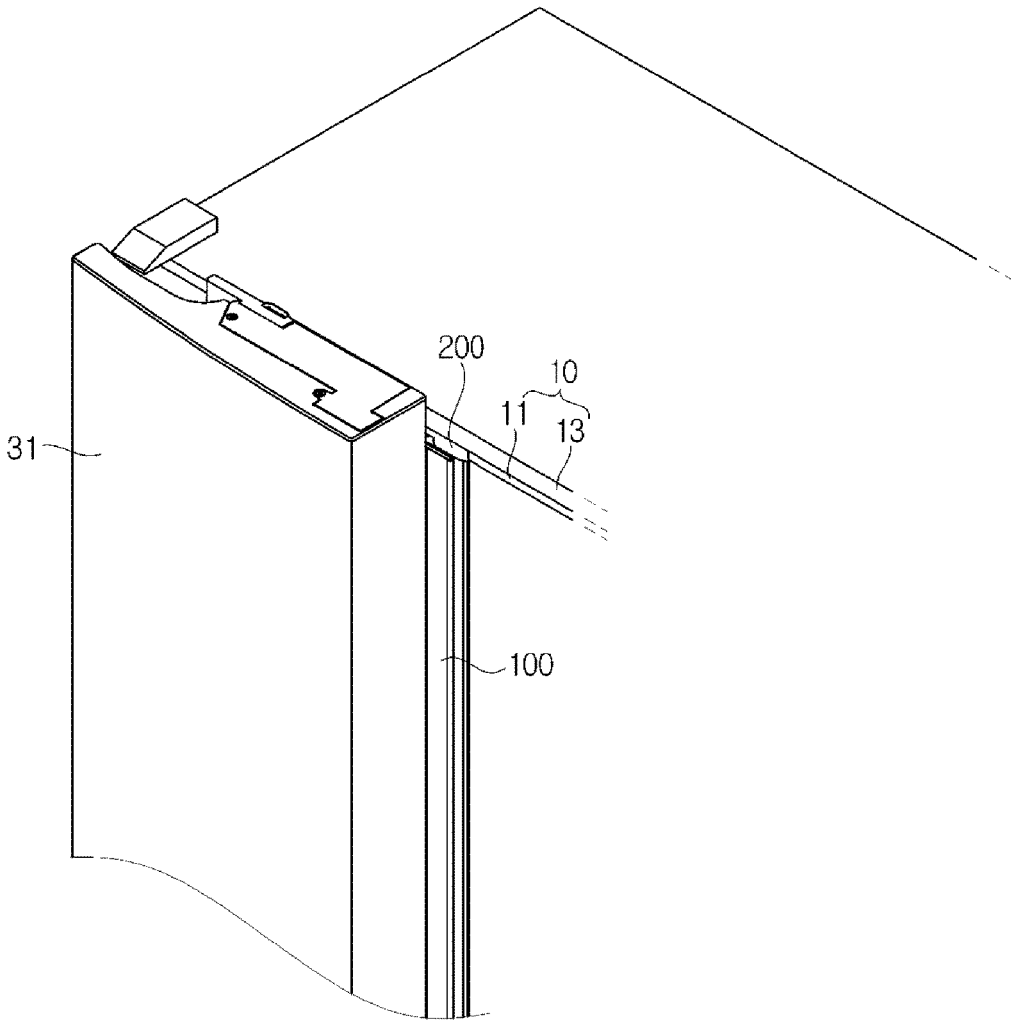
FIG. 2 is an enlarged view of a pivoting bar and a guide device installed in the refrigerator of FIG. 1.

FIG. 2 is an enlarged view of a pivoting bar 100 and a guide device 200 installed in the refrigerator 1 of FIG. 1.

Figure 3:
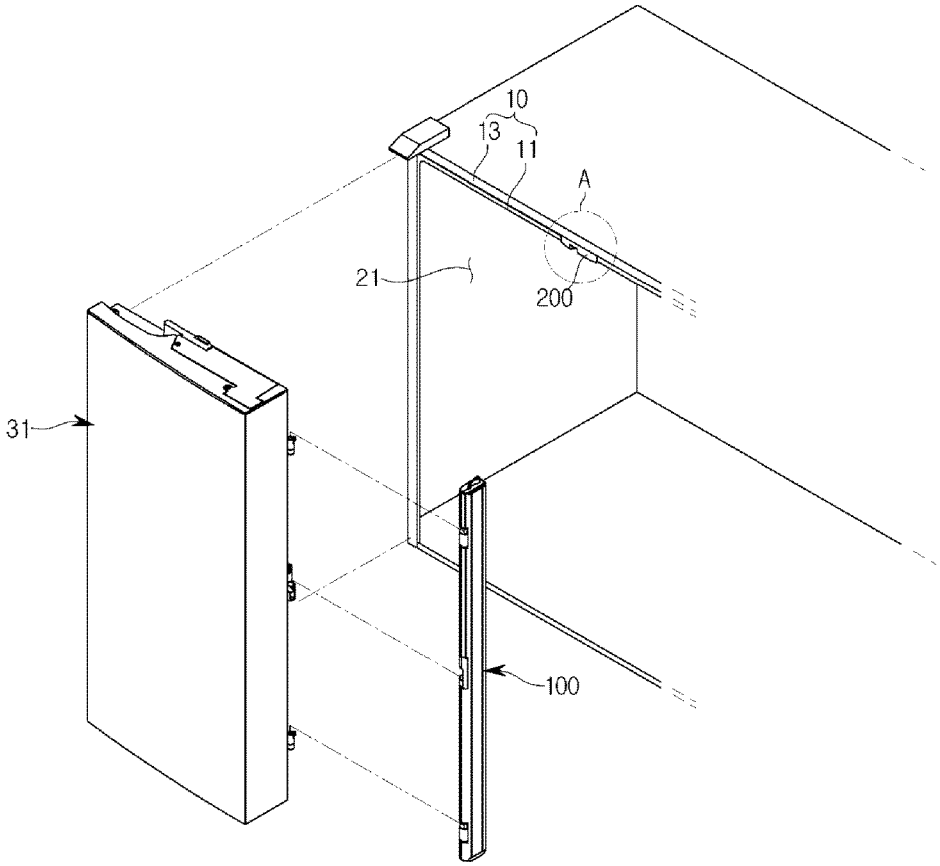
FIG. 3 is an exploded perspective view illustrating a coupling between a door and the pivoting bar of FIG. 2.
Figure 4:
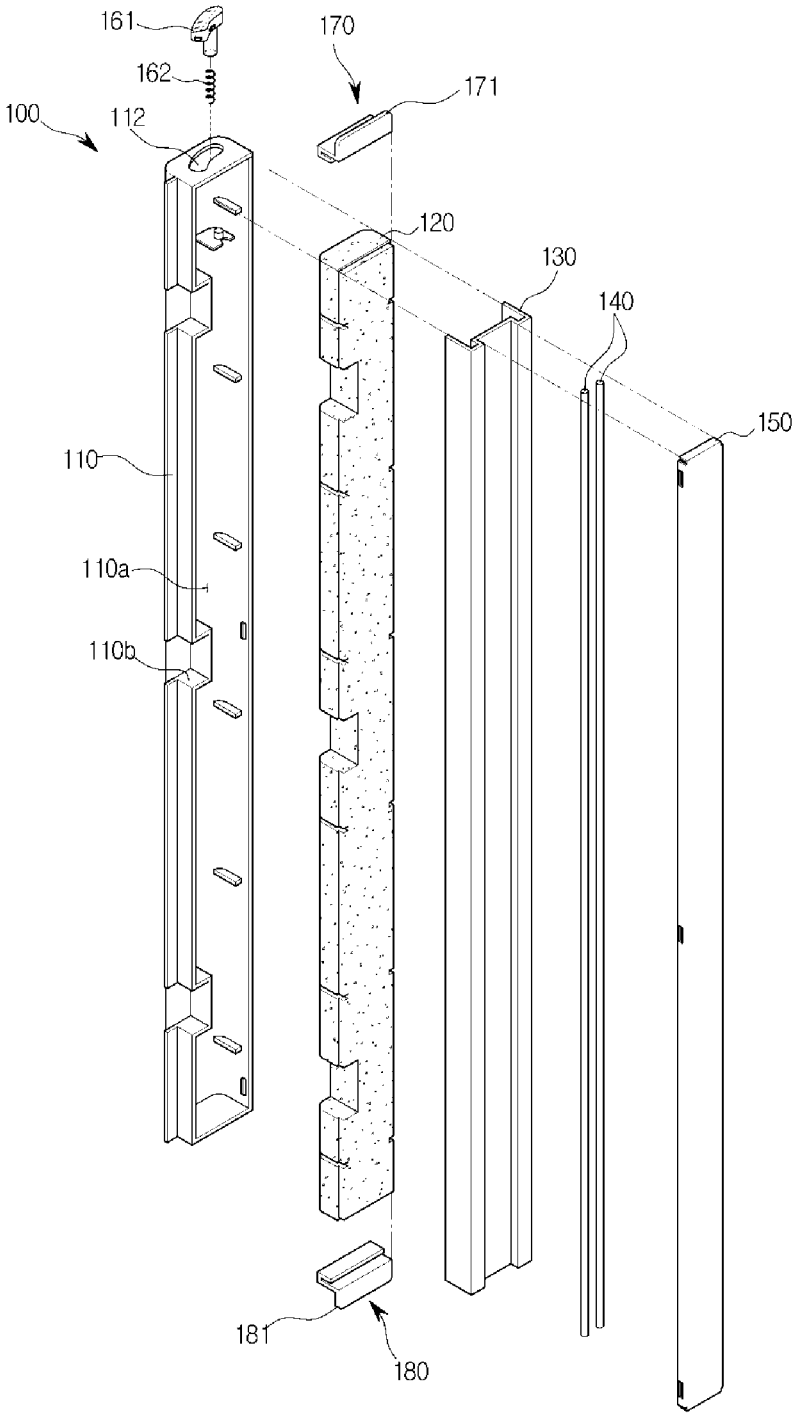
FIG. 4 is an exploded perspective view illustrating a configuration of the pivoting bar of the refrigerator of FIG. 1.
Figure 5:
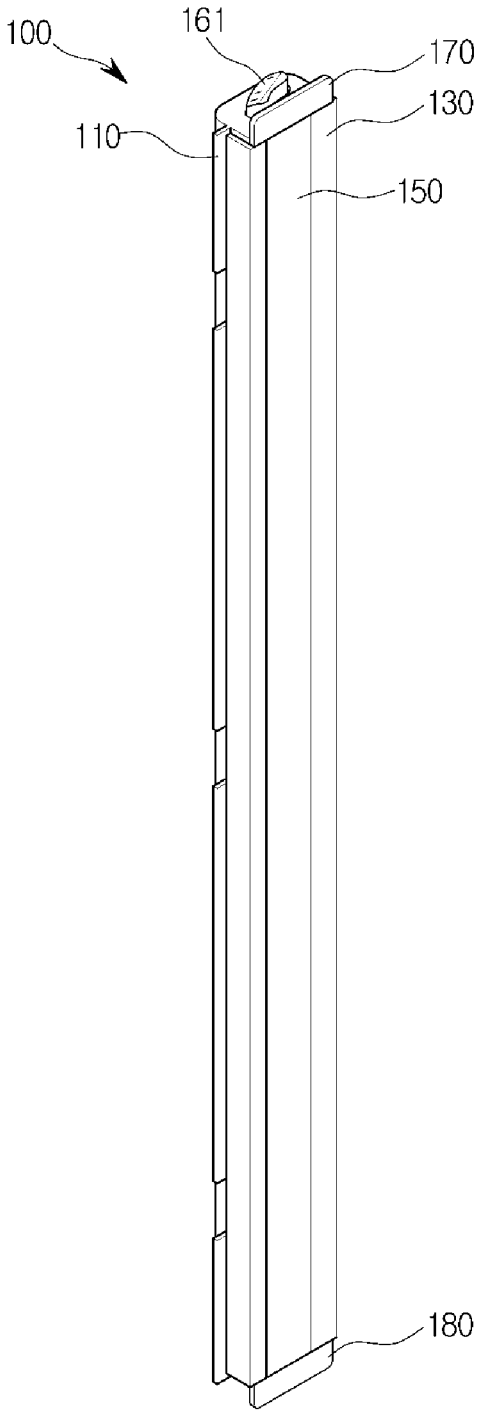
FIG. 5 is a coupled perspective view illustrating the pivoting bar of the refrigerator of FIG. 1.
Figure 6:
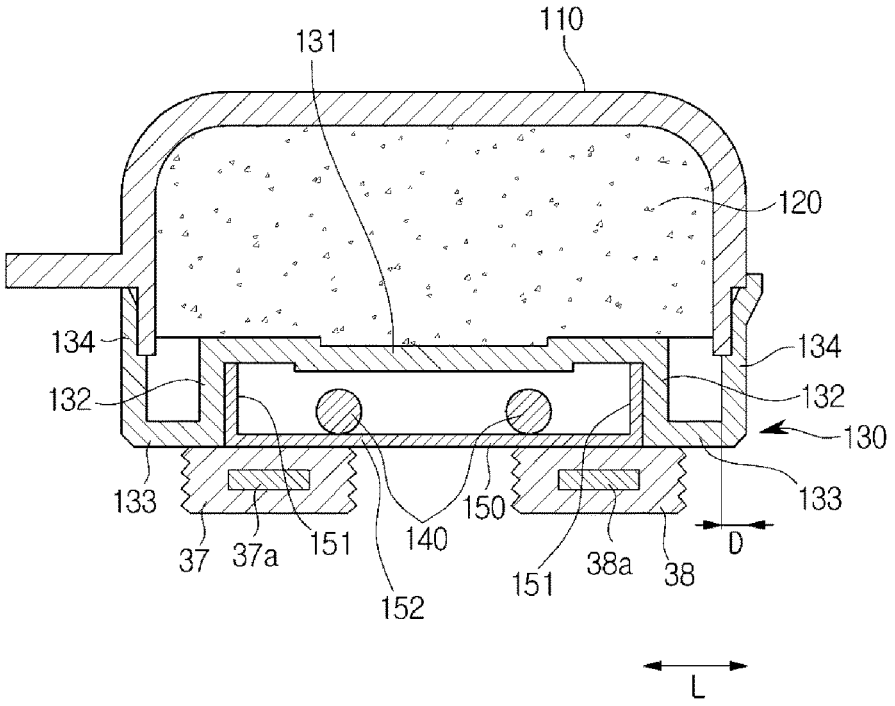
FIG. 6 is a cross-sectional view of the pivoting bar of the refrigerator of FIG. 1.

FIG. 3 is an exploded perspective view illustrating a coupling between the first door 31 and the pivoting bar 100 of FIG. 2. FIG. 4 is an exploded perspective view illustrating a configuration of the pivoting bar 100 of the refrigerator 1 of FIG. 1. FIG. 5 is a coupled perspective view illustrating the pivoting bar 100 of the refrigerator 1 of FIG. 1. FIG. 6 is a cross-sectional view of the pivoting bar 100 of the refrigerator of FIG. 1.

Referring to FIGS. 1 to 6, the refrigerator 1 may further include the pivoting bar 100 and the guide device 200. As shown in FIG. 1, the gaps between the first door 31 and the second door 33 and the body 10 may be sealed by the first gasket 37 and the second gasket 38, thereby preventing a cool air leak. However, a gap between the first door 31 and the second door 33 may be formed in such a way that the cool air may leak. Accordingly, to prevent the cool air leak in the storage compartment 20, the first storage compartment 21, which is one storage compartment and is opened and closed by the plurality of doors 31 and 33, may include the pivoting bar 100 installed on one of the plurality of doors 31 and 33. The pivoting bar 100 may prevent and block the cool air leak between the first door 31 and the second door 33 while the first door 31 and the second door 33 are closed.

As shown in FIG. 3, the pivoting bar 100 may be pivotably coupled with one side of the first door 31. The pivoting bar 100 may be hinge-coupled with the one side of the first door 31. The pivoting bar 100 may seal the gap between the first door 31 and the second door 33 while being rotated according to an opening and closing of the first door 31.

The pivoting bar 100 may be configured to have a bar shape formed to be long in a longitudinal direction of the first door 31. The pivoting bar 100 may include an insertion protrusion 161 installed on a top thereof. The insertion protrusion 161 may be configured to be moved along a guide groove 201 formed in the guide device 200 and to allow the pivoting bar 100 to pivot.

The pivoting bar 100 includes a case 110 which has an accommodating space 110*a* and one open side, an insulating member 120 accommodated in the accommodating space 110*a* of the case 110, a cover 130 coupled with the one open side of the case 110, a metal plate 150 coupled with an outside of the cover 130, and a heating member 140 disposed in a space between the cover 130 and the metal plate 150.

The case 110 which forms an exterior of the pivoting bar 100 may have the accommodating space 110 therein and the one side which is open and may be covered by the cover 130. The case 110 may include a hinge bracket coupling portion 110*b* coupled with a hinge bracket 70 (refer to FIG. 10).

Figure 10:
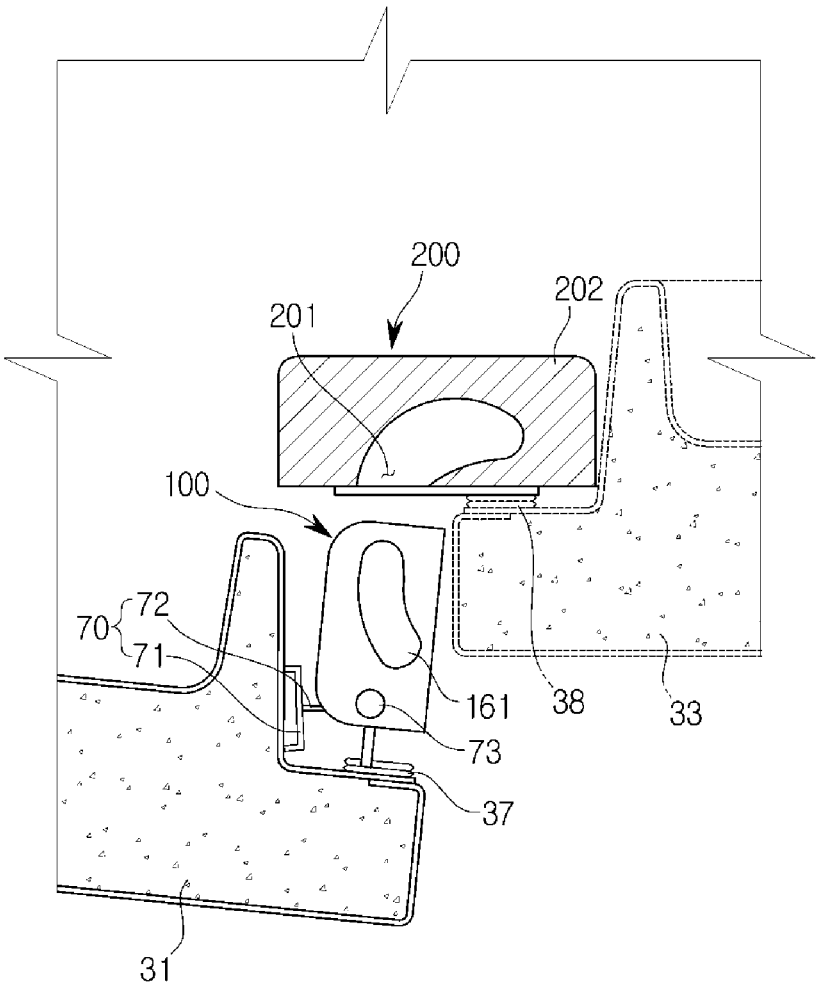
FIGS. 10 to 13 are views illustrating an operation of the pivoting bar of the refrigerator of FIG. 1.

The hinge bracket 70 may include a fixing portion 71 (refer to FIG. 10) fixed to the rear surface of the first door 31 and a hinge bar 72 (refer to FIG. 10) which connects the fixing portion 71 with the pivoting bar 100 to allow the pivoting bar 100 to pivot on a pivot 73 (refer to FIG. 10). The fixing portion 71 may be coupled with the rear surface of the first door 31 using a fastening member such as a screw.

Also, a through portion 112 may be provided on a top surface of the case 110 to allow the insertion protrusion 161 inserted into the guide groove 201 of the guide device 200 to protrude outside the case 110. The through portion 112 may be formed as a hole having the same shape as that of the insertion protrusion 161.

However, although the guide device 200 is formed on top of the body 10 and the insertion protrusion 161 protrudes above the pivoting bar 100 in the present embodiment, the guide device 200 may be formed below the body 10 and the insertion protrusion 161 may protrude below the pivoting bar 100. Accordingly, the through portion 112 of the case 110 may be formed on a bottom surface of the case 110. The case 110 may be formed of a plastic material through integrally injection molding.

The insulating member 120 is for insulating the storage compartment 20 and may be formed of expanded polystyrene (EPS) which has excellent heat insulation property and has a small weight. The insulating member 120 may be formed substantially in a shape insertable into the accommodating space 110*a* of the case 110 and may be inserted into the accommodating space 110*a* of the case 110.

The cover 130 which covers the one open side of the case 110 may be coupled with the one open side of the case 110 after the insulating member 120 is inserted into the accommodating space 110*a* of the case 110.

The cover 130 has a cross section having a shape bent several times and forms a part of a side of the pivoting bar 100 and a part of a rear surface thereof. Here, the rear surface of the pivoting bar 100 indicates a surface which faces the first and second gaskets 37 and 38 of the first and second doors 31 and 33.

In detail, the cover 130 includes an insulating member contact portion 131 in contact with the insulating member 120, a second coupling portion 132 with which the metal plate 150 which will be described below is coupled, a non-conducting portion 133 which protrudes toward the metal plate 150, and a side forming portion 134 which forms at least the part of the side of the pivoting bar 100. The case 130 may be formed of a plastic material having a low thermal conductivity through integrally injection molding.

The metal plate 150 may be coupled with the outside of the cover 130. The metal plate 150 is in close contact with the first and second gaskets 37 and 38 by a magnetic force of magnets 37*a* and 37*b* which are included in the first and second gaskets 37 and 38, and formed of a metal material to provide rigidity to the pivoting bar 100.

The metal plate 150 may include a first coupling portion 151 coupled with the second coupling portion 132 of the cover 130 and a gasket contact portion 152 in contact with the first and second gaskets 37 and 38. The first coupling portion 151 of the metal plate 150 and the second coupling portion 132 of the cover 130 may be mutually coupled using a fastening member such as a screw or an adhesive member.

Meanwhile, the heating member 140 which emits heat may be disposed in a space formed by the first coupling portion 151 and the gasket contact portion 152 of the metal plate 150 to prevent dew formation on the metal plate 150 caused by a difference in temperature between an inside and outside of the storage compartment 20.

Here, to prevent heat generated by the heating member 140 from being excessively transferred to the metal plate 150, a heating cable formed of an insulating material such as silicone or fluorinated ethylene propylene (FEP) which covers a heating wire of the metal plate 150 may be used as the heating member 140.

Accordingly, the heating member 140 may be disposed to be in linear contact with the metal plate 150 instead of being in contact with surfaces therewith, to transfer only minimal heat for preventing the dew formation on the metal plate 150 to the metal plate 150.

The non-conducting portion 133 of the cover 130, which has been described above, and the gasket contact portion 152 form the rear surface of the pivoting bar 100. The gasket contact portion 152 of the metal plate 150 is formed in a center part of the rear surface of the pivoting bar 100, and the non-conducting portion 133 of the cover 130 is formed on both peripheral portions of the rear surface of the pivoting bar 100.

It is necessary for the non-conducting portion 133 of the cover 130 to have a certain length L to prevent heat conducted along the gasket contact portion 152 of the metal plate 150 from being conducted to the side of the pivoting bar 100.

The length L of the non-conducting portion 133 of the cover 130 may be approximately longer than the thickness D of the cover 130. A length of the gasket contact portion 152 of the metal plate 150 may be reduced and the length L of the non-conducting portion 133 of the cover 130 may be extended no more than the extent of contact between the metal plate 150 and the first and second gaskets 37 and 38 due to magnetic force of the magnets 37*a* and 38*a* included in the first and second gaskets 37 and 38.

Through such a configuration described above, in a state in which the first door 31 and the second door 33 are closed, the pivoting bar 100 may be in contact with the first and second gaskets 37 and 38 of the first and second doors 31 and 33 and may seal the gap between the first door 31 and the second door 33 while minimizing an intrusion of the heat generated by the heating member 140 of the pivoting bar 100 into the storage compartment 20.

Accordingly, since not only the heat insulating property of the pivoting bar 100 improves but also thermal losses of the heating member 140 are minimized, energy for preventing the dew formation on the pivoting bar 100 may be reduced.

Meanwhile, sealing members 170 and 180 for sealing a gap between the pivoting bar 100 and the body 10 when the first and second doors 31 and 33 are closed may be provided at a top end and a bottom end of the pivoting bar 100.

The sealing member 170 on the top end of the pivoting bar 100 and the sealing member 180 on the bottom end of the pivoting bar 100 may include barriers 171 and 181, respectively, which protrude to seal a gap between the guide device 200 of the body 10 and the pivoting bar 100 when the first door 31 is closed.

When the guide device 200 is provided on an upper surface of the body 10, the sealing member 170 may seal the gap between the guide device 200 and the pivoting bar 100.

The sealing members 170 and 180 are formed of a flexible material such as rubber to smoothly seal the gap between the body 10 and the pivoting bar 100 without damage caused by collision.

The guide device 200 may be installed on one side of the body 10 to allow the pivoting bar 100 to pivot according to the opening and closing of the first door 31. The guide device 200 may be installed in a position in which at least a part thereof may face the first door 31 when the first door 31 is closed. The guide device 200 may be installed in a position on a top surface of the inner casing 11 of the first storage compartment 21 to face the first door 31.

The guide device 200 may include a guide groove 201 formed on a guide body 202. The guide groove 201 may be provided as a path on which the insertion protrusion 161 of the pivoting bar 100 is moved inside the guide device 200. The guide groove 201 may have a rounded shape to allow the pivoting bar 100 to pivot while the insertion protrusion 161 is being moved inside the guide device 200.

Figure 7:
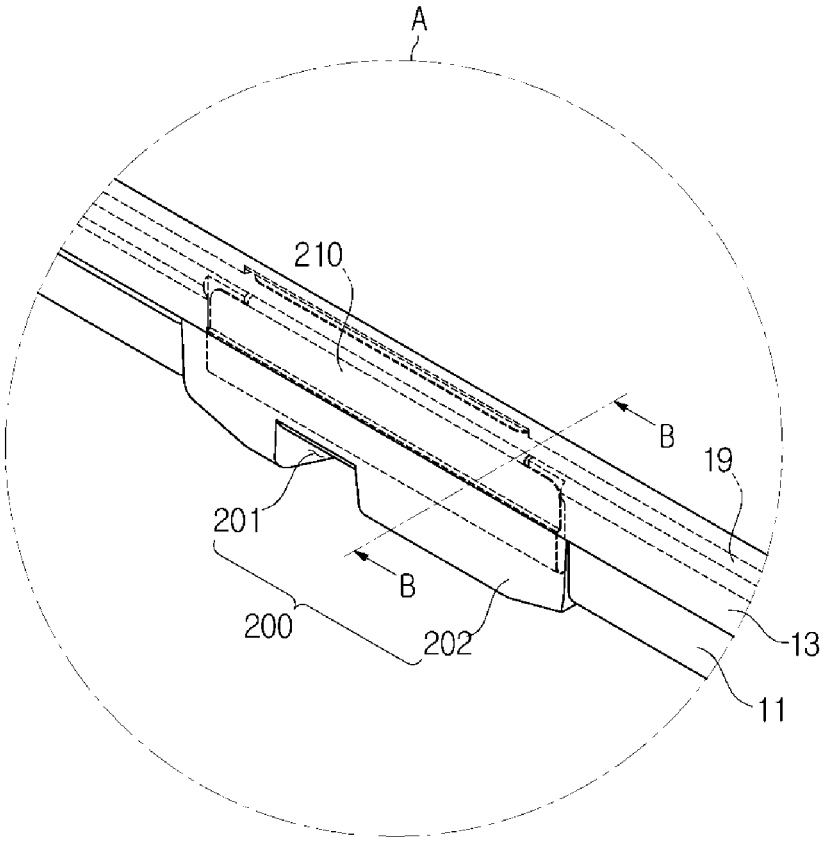
FIG. 7 is an enlarged view of area A of FIG. 3 illustrating the guide device and a heat transfer pipe and a heat transfer member installed therein.
Figure 8:
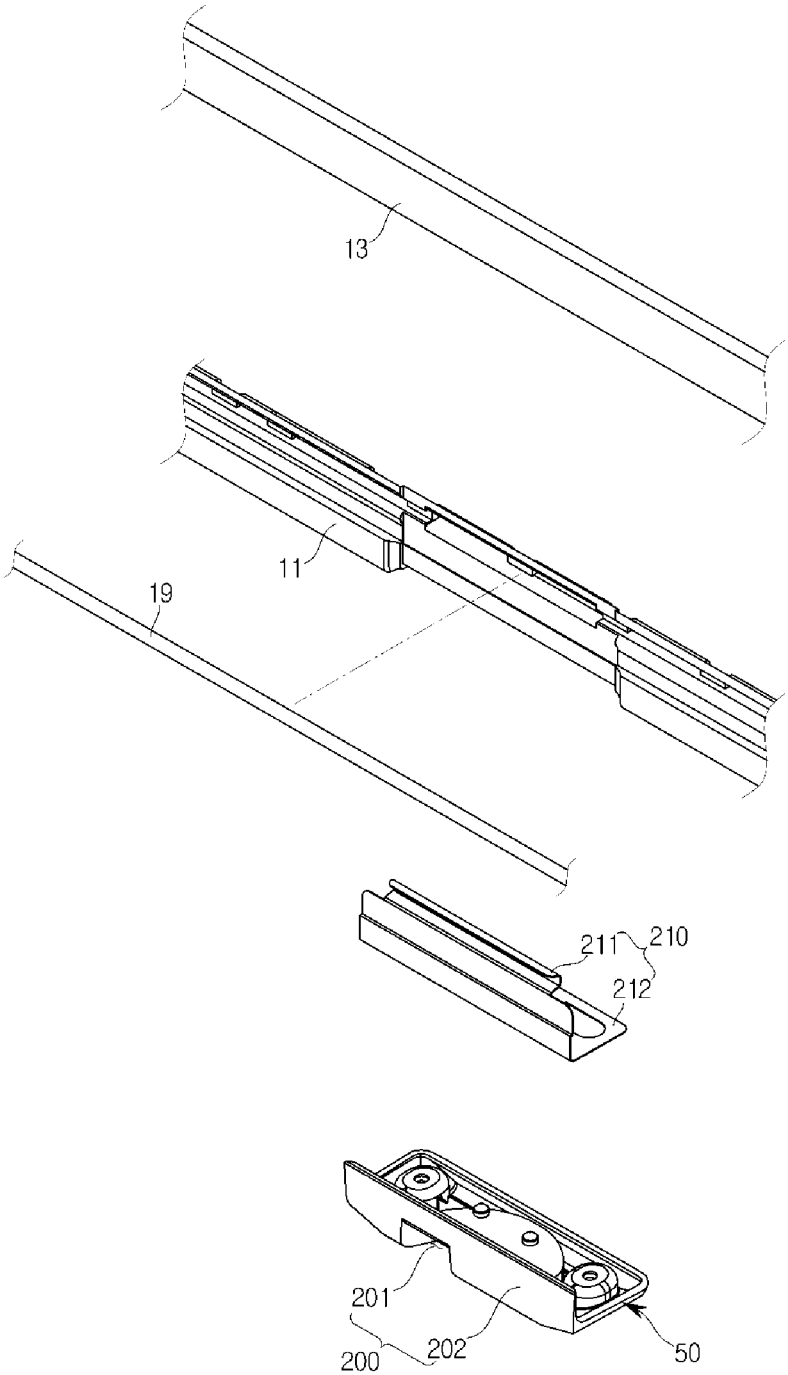
FIG. 8 is an exploded perspective view illustrating coupling among the guide device and the heat transfer pipe and the heat transfer member in area A of FIG. 3.
Figure 9:
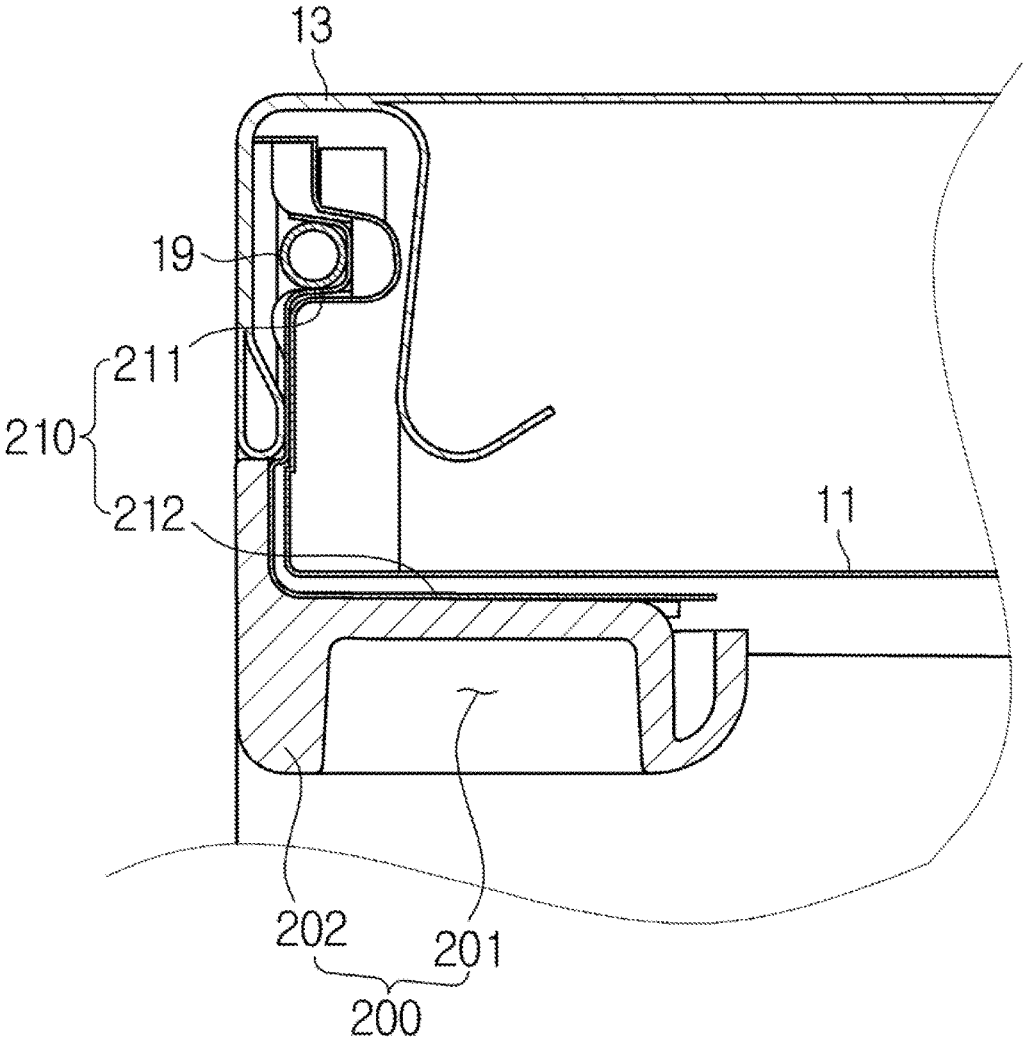
FIG. 9 is a cross-sectional view of the guide device viewed from line B-B of FIG. 7.

FIG. 7 is an enlarged view of area A of FIG. 3 illustrating the guide device 200 and a heat transfer pipe 19 and a heat transfer member 210 installed therein. FIG. 8 is an exploded perspective view illustrating a coupling among the guide device 200 and the heat transfer pipe 19 and the heat transfer member 210 in area A of FIG. 3. FIG. 9 is a cross-sectional view of the guide device 200 viewed from line B-B of FIG. 7.

Referring to FIGS. 2 to 9, the refrigerator 1 may further include the heat transfer member 210. The heat transfer member 210 may be provided to allow one side thereof to be in contact with the guide device 200 to increase a temperature of the guide device 200.

The heat transfer pipe 19 may be installed between the inner casing 11 and the outer casing 13. The heat transfer pipe 19 may be disposed between the inner casing 11 and the outer casing 13 to surround a front part of the storage compartment 20. The heat transfer pipe 19 may be provided to allow a high temperature fluid to be moved to increase a temperature of the inner casing 11. Accordingly, when the door 30 is opened, it is possible to prevent a dew formation phenomenon generated due to a difference between the temperature of the inner casing 11 and a temperature of outside air. The heat transfer pipe 19 may be provided in such a way that one side thereof is connected to the compressor to allow a high temperature refrigerant compressed by the compressor to be moved.

The heat transfer member 210 may be provided to be in contact with the heat transfer pipe 19 and the guide device 200 installed inside the body 10, respectively. Through this, the heat transfer member 210 may be configured to transfer heat from the heat transfer pipe 19 to the guide device 200.

The heat transfer member 210 may include a first connection portion 211 and a second connection portion 212.

The first connection portion 211 may be provided to be in contact with the heat transfer pipe 19. The first connection portion 211 may be provided to surround a part of the heat transfer pipe 19. The first connection portion 211 may be disposed together with the heat transfer pipe 19 between the inner casing 11 and the outer casing 13.

The second connection portion 212 may be provided to be in contact with the guide device 200. The second connection portion 212 may be configured to be bent from the first connection portion 211 and to be in contact with the guide device 200. The second connection portion 212 may be disposed between the inner casing 11 and the guide device 200 coupled with the inner casing 11.

The heat transfer member 210 may be formed of a material having a higher thermal conductivity than the inner casing 11. For example, the heat transfer member 210 may include aluminum.

Generally, the inner casing 11 may be formed of injection-molded plastic having a low thermal conductivity and the guide device 200 installed at the inner casing 11 may be formed of the same injection-molded plastic as that of the inner casing 11. Since the guide device 200 is coupled with and installed at the inner casing 11, it is not easy to perform heat transfer from the heat transfer pipe 19 to the guide device 200 through the inner casing 11. Accordingly, when the first and second doors 31 and 33 are opened, the dew formation phenomenon may occur on the guide device 200 due to the difference in temperature between the guide device 200 and the outside air.

According to one embodiment of the present disclosure, the heat transfer member 210 is in direct contact with each of the heat transfer pipe 19 and the guide device 200, thereby easily performing heat transfer to the guide device 200. Also, since the heat transfer member 210 is formed of a material having a higher thermal conductivity than the inner casing 11, it is easy to perform heat transfer to the guide device 200. Due to such a configuration as described above, the temperature of the guide device 200 increases due to the heat transfer through the heat transfer member 210 and it is possible to reduce the difference in temperature between the guide device 200 and the outside air when the first and second doors 31 and 33 are opened. Accordingly, it is possible to prevent the dew formation phenomenon generated on the guide device 200 due to the difference in temperature with the outside air.

FIGS. 10 to 13 are views illustrating an operation of the pivoting bar 100 of the refrigerator 1 of FIG. 1. Referring to FIGS. 10 to 13, the operation of the pivoting bar 100 of the refrigerator 1 according to one embodiment of the present disclosure will be described briefly.

Figure 11:
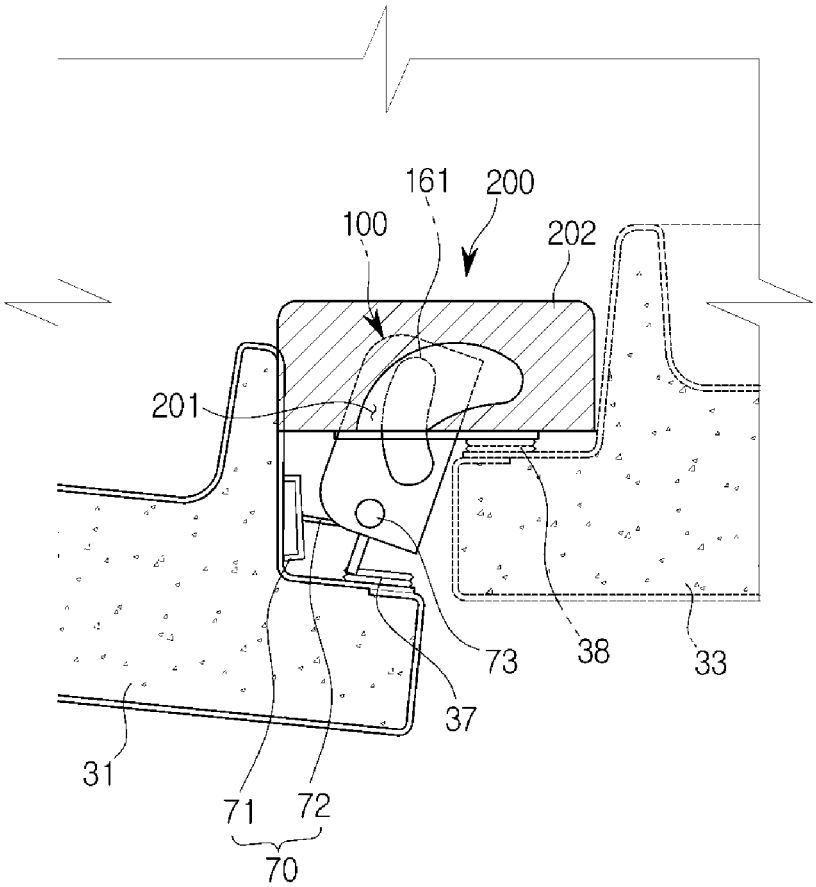
Figure 12:
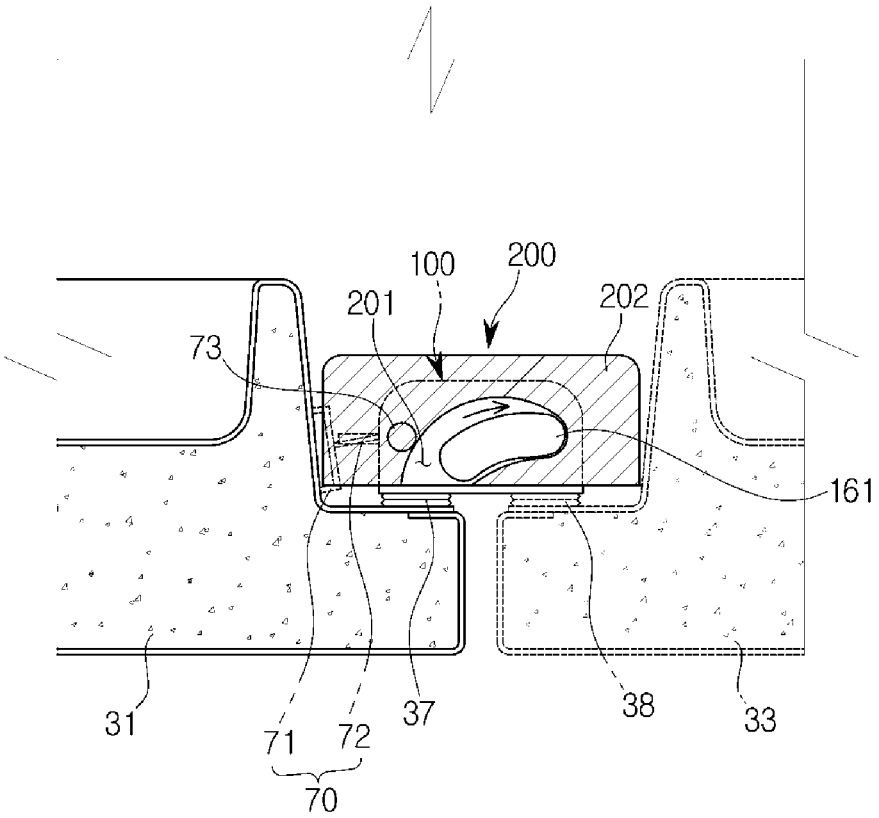

FIG. 10 illustrates a normal position of the pivoting bar 100 when the first door 31 is opened. FIG. 11 illustrates a process of closing the first door 31 in a state shown in FIG. 10. FIG. 12 illustrates a state in which the first door 31 and the second door 33 are closed.

Figure 13:
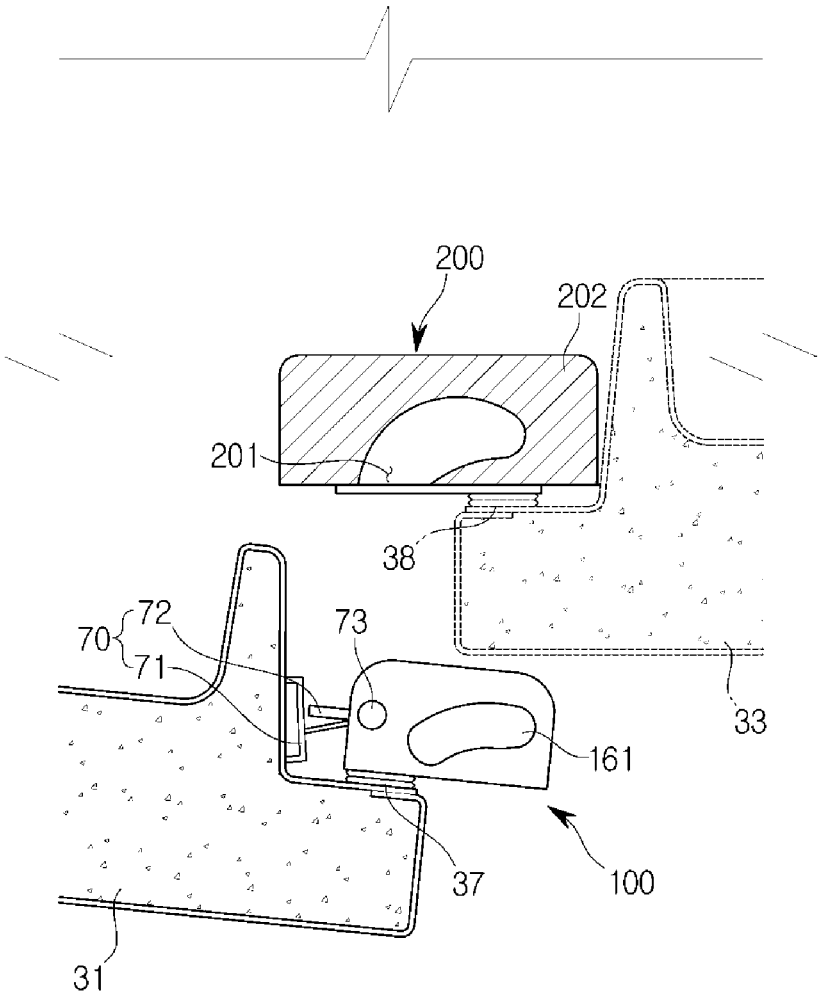

FIG. 13 illustrates an abnormal position of the pivoting bar 100 when the first door 31 is opened.

As shown in FIG. 10, the normal position of the pivoting bar 100 when the first door 31 is opened is a position in which the rear surface of the pivoting bar 100 is approximately vertical to a longitudinal direction of the first door 31. Hereinafter, the position will be referred to as a vertical position.

When the pivoting bar 100 is in the vertical position and the first door 31 is closed, as shown in FIG. 11, the insertion protrusion 161 of the pivoting bar 100 may enter the inside of the guide groove 201 through an entrance of the guide groove 201 of the guide device 200 provided at the body 10.

The insertion protrusion 161 which enters the inside of the guide groove 201 rotates along a curved surface of the guide groove 201 and the pivoting bar 100 also rotates as the insertion protrusion 161 rotates.

At last, as shown in FIG. 12, when the first door 31 is completely closed, the pivoting bar 100 may be disposed in a position in which the rear surface of the pivoting bar 100 is approximately horizontal to the longitudinal direction of the first door 31 and the second door 33 to be in contact with the first and second gaskets 37 and 38 and to seal the gap between the first door 31 and the second door 33. Hereinafter, such position of the pivoting bar 100 will be referred to as a horizontal position.

Therefore, while the first door 31 is being closed, the pivoting bar 100 is allowed to rotate clockwise in the drawings as sequentially shown in FIGS. 10, 11, and 12.

Also, conversely, while the first door 31 is being opened, the pivoting bar 100 rotates counterclockwise in the drawings as sequentially shown in FIGS. 12, 11, and 10. When the first door 31 is completely opened, the pivoting bar 100 is disposed in the vertical position.

As described above, the pivoting bar 100 is disposed in the vertical position in such a way that the first door 31 may be closed while the pivoting bar 100 does not interfere with the second door 33 when the second door 33 is closed. Also, the insertion protrusion 161 of the pivoting bar 100 may enter the guide groove 201 through the entrance of the guide groove 201.

However, when the first door 31 is opened, a case in which the pivoting bar 100 is disposed in the horizontal position due to an incorrect operation of a user may occur. In this case, while the first door 31 is being closed, not only may the pivoting bar 100 interfere with the second door 33, but the insertion protrusion 161 of the pivoting bar 100 may also not be able to enter the guide groove 201 through the entrance of the guide groove 201, and while the insertion protrusion 161 will not interfere with the second door which is opened, it will collide with the guide body 202.

Accordingly, not only may cool air in the storage compartment 20 leak, but the insertion protrusion 161 may also be damaged since the first door 31 is not completely closed.

Accordingly, the insertion protrusion 161 of the pivoting bar 100 of the refrigerator 1 according to one embodiment of the present disclosure is configured to be vertically movable to be insertable into the guide groove 201 while not colliding with the guide body 202 even when the pivoting bar 100 is in the horizontal position. Such a configuration of the insertion protrusion 161 described above will be described below.

Figure 14:
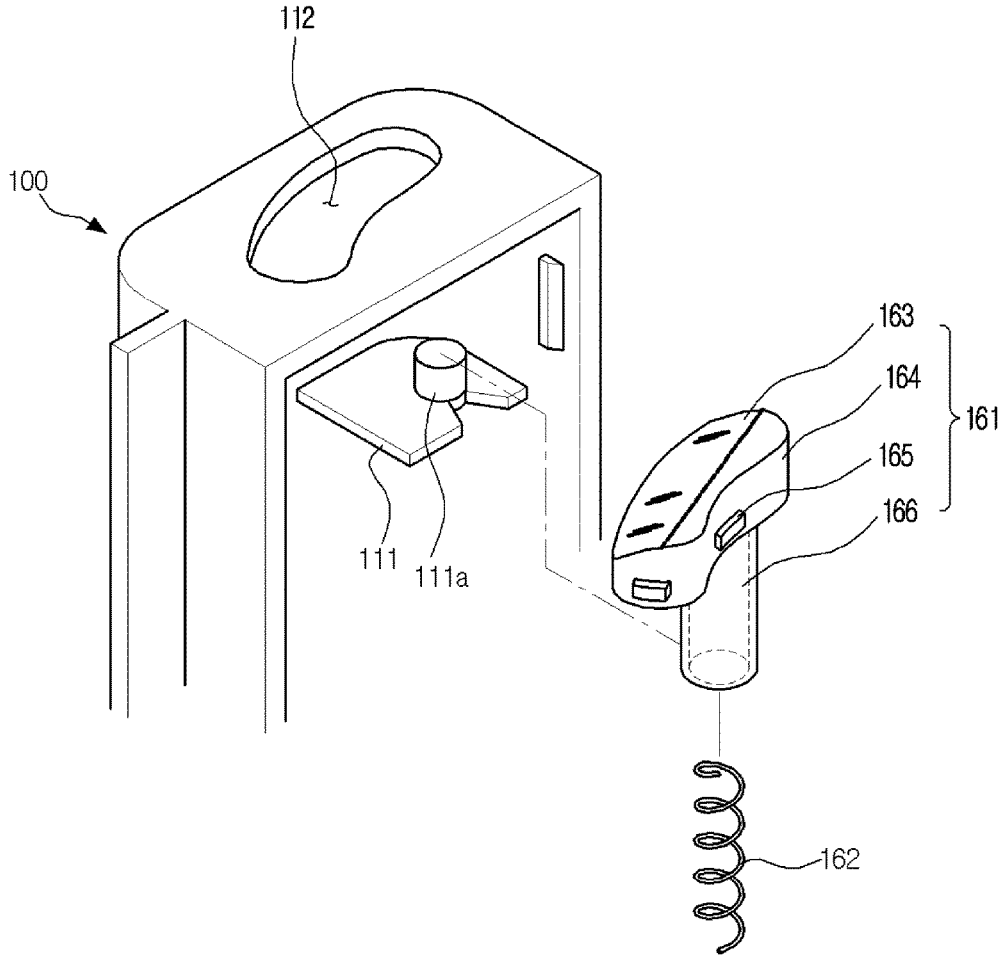
FIG. 14 is a view illustrating a configuration of an insertion protrusion of the pivoting bar of the refrigerator of FIG. 1.
Figure 15:
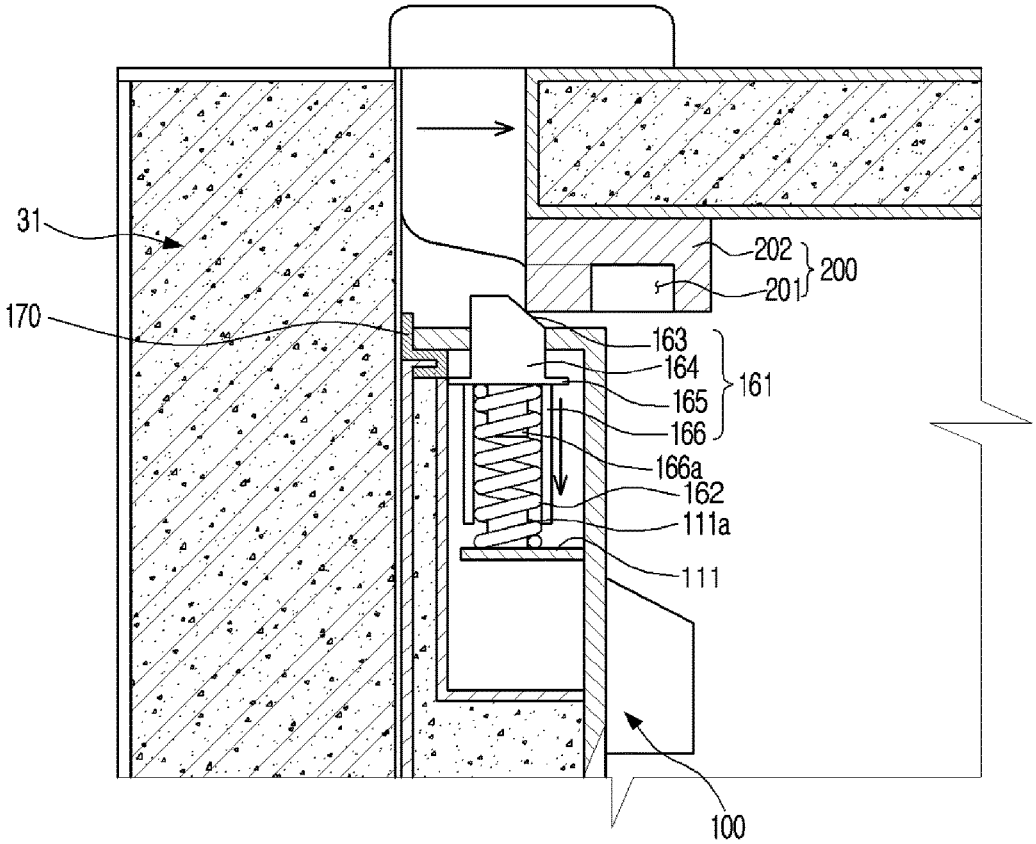
FIGS. 15 and 16 are views illustrating a vertical movement of the insertion protrusion of the pivoting bar of the refrigerator of FIG. 1.
Figure 16:
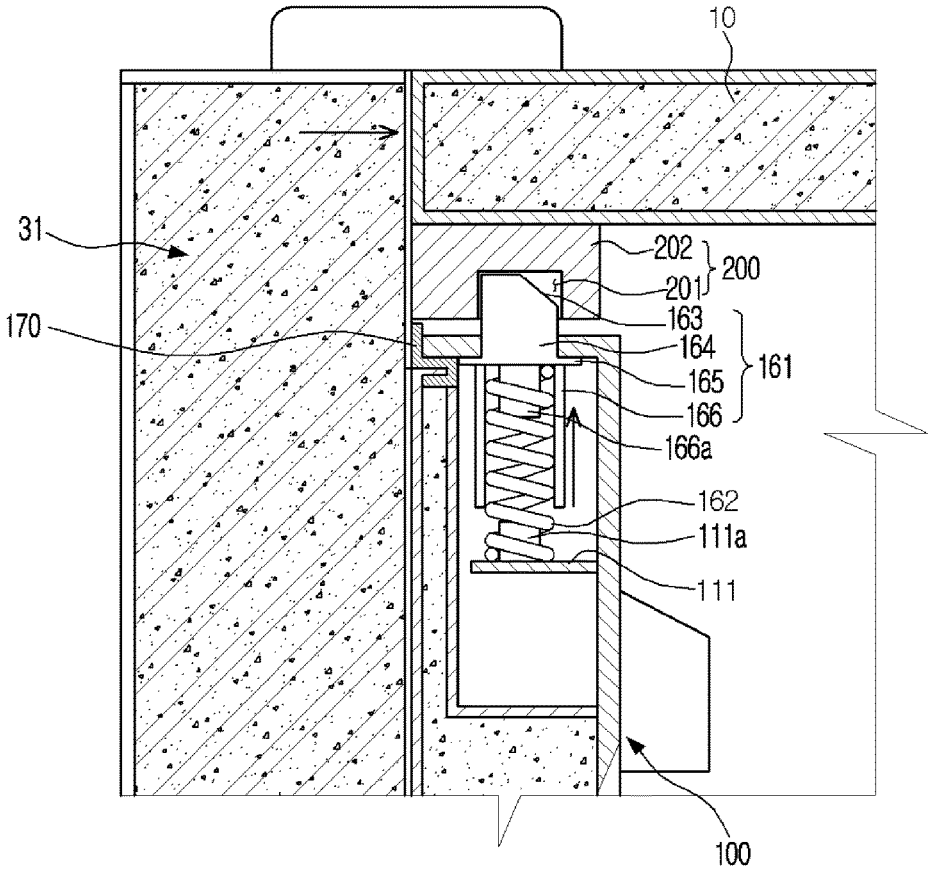

FIG. 14 is a view illustrating the configuration of the insertion protrusion 161 of the pivoting bar 100 of the refrigerator 1 of FIG. 1. FIGS. 15 and 16 are views illustrating a vertical movement of the insertion protrusion 161 of the pivoting bar 100 of the refrigerator 1 of FIG. 1.

Referring to FIGS. 14 to 16, the insertion protrusion 161 includes a body portion 166 disposed inside the pivoting bar 100, a protrusion 164 which protrudes outside the pivoting bar 100 through the through portion 112 of the pivoting bar 100, a protrusion stopper 165 which prevents the insertion protrusion from deviating outward from the pivoting bar 100, and a slanted surface 163 formed on the protrusion 164.

The body portion 166 includes a hollow portion therein to allow an elastic member 162 to be inserted therein. The insertion protrusion 161 becomes elastically biased due to the elastic member 162 while the protrusion 164 is protruding outside the pivoting bar 100.

The case 110 of the pivoting bar 100 may include a supporter 111 which supports the elastic member 162 and a supporting bar **111*a* which protrudes from the supporter 111. The body portion 166 may include a supporting bar 166*a* which supports the elastic member 162**.

The protrusion 164 has a shape approximately identical to that of the through portion 112 and has a small size to pass through the through portion 112. The protrusion stopper 165 which limits a protrusion range of the protrusion 164 is provided outside the protrusion 164.

The slanted surface 163 formed on the protrusion 164 is for converting a horizontal force to a vertical force and allows the insertion protrusion 161 to move vertically due to horizontal pressurization by the guide body 202 while the first door 31 is being closed when the pivoting bar 100 is in the horizontal position.

Accordingly, as shown in FIG. 13, when the pivoting bar 100 is in the horizontal position and the first door 31 is closed, the insertion protrusion 161 may collide with the guide body 202 and may descend due to a pressure applied by the guide body 202.

When the first door 31 is completely closed in this state, the insertion protrusion 161 may ascend due to restoring force of the elastic member 162 and may be inserted into the guide groove 201.

According to such a configuration described above, the first door 31 of the refrigerator 1 according to one embodiment of the present disclosure may be closed without interference even when the pivoting bar 100 is rotated into the horizontal position.

Accordingly, convenience of using may increase and a loss of the cool air caused by incomplete closing of the first and second doors 31 and 33 may be prevented.

As is apparent from the above description, the refrigerator in accordance with one embodiment of the present disclosure increases quality and prevents the corrosion of metal by preventing the dew formation phenomenon which occurs in the refrigerator.

It is possible to prevent the dew formation phenomenon by providing a heat transfer member to a guide device installed in a body to reduce a difference in temperature between the guide device and outside air.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a body comprising an inner casing and an outer casing;

a storage compartment provided in the body and having a front opening;

a first door and a second door each pivotably coupled with the body and configured to open and close the front opening of the storage compartment;

a pivoting bar pivotably coupled with the first door;

a guide device coupled with the inner casing of the body to induce the pivoting bar to pivot;

a heat transfer pipe through which a refrigerant is movable to cause the heat transfer pipe to have a higher temperature than the guide device, the heat transfer pipe between the inner casing and the outer casing and extending along a front edge of the storage compartment; and a heat transfer member being formed of a material having a higher thermal conductivity than the inner casing and comprising a first connection portion between the inner casing and the outer casing, and in contact with the heat transfer pipe, and a second connection portion in contact with the guide device and disposed between the inner casing and the guide device to transfer heat from the heat transfer pipe to the guide device.

2. The refrigerator of claim 1, wherein the first connection portion has a shape which surrounds a part of the heat transfer pipe so that the heat transfer member is thereby in contact with the heat transfer pipe.

3. The refrigerator of claim 2, wherein the second connection portion is bent from the first connection portion.

4. The refrigerator of claim 1, wherein the heat transfer member comprises aluminum.

5. A refrigerator comprising:

a body comprising an inner casing and an outer casing;

a storage compartment provided in the body and having a front opening;

a first door and a second door each pivotably coupled with the body and configured to open and close the front opening of the storage compartment;

a pivoting bar pivotably coupled with the first door;

a guide device coupled with the inner casing of the body to induce the pivoting bar to pivot;

a heat transfer pipe through which a refrigerant is movable to cause the heat transfer pipe to have a higher temperature than the guide device, the heat transfer pipe between the inner casing and the outer casing and disposed at a front edge of the storage compartment; and a heat transfer member to transfer heat from the heat transfer pipe to the guide device to increase a temperature of the guide device, wherein the heat transfer member comprises a first connection portion between the inner casing and the outer casing, and in contact with the heat transfer pipe, and a second connection portion in contact with the guide device and disposed between the inner casing and the guide device, to transfer heat from the heat transfer pipe to the guide device.

6. The refrigerator of claim 5, wherein the heat transfer member is formed of a material having a higher thermal conductivity than the inner casing.

7. The refrigerator of claim 6, wherein the heat transfer member comprises aluminum.

8. The refrigerator of claim 5, wherein the first connection portion has a shape which surrounds a part of the heat transfer pipe.

9. The refrigerator of claim 8, wherein the second connection portion is bent from the first connection portion.

10. A refrigerator comprising:

a body;

a storage compartment provided in the body and having a front opening;

a first door and a second door each pivotably coupled with the body and configured to open and close the front opening of the storage compartment;

a pivoting bar pivotably coupled with the first door;

a guide device coupled with the body to induce the pivoting bar to pivot;

a heat transfer pipe, on the body, through which a refrigerant is movable to cause the heat transfer pipe to have a higher temperature than the guide device; and a heat transfer member in contact with both the heat transfer pipe and the guide device and that transfers heat from the heat transfer pipe to the guide device to thereby increase temperature of the guide device, wherein the heat transfer member comprises a first connection portion in contact with the heat transfer pipe, and a second connection portion being in contact with the guide device and disposed between the body and the guide device coupled with the body, to transfer heat from the heat transfer pipe to the guide device.

* * * * *